US005678830A

United States Patent [19]

Chang

[11] Patent Number: 5,678,830

[45] Date of Patent: Oct. 21, 1997

[54] WIRE COVER PACKING RING OF AN ELECTRIC FAN

[76] Inventor: Hsin Yan Chang, P.O. Box 82-144, Taipei, Taiwan

[21] Appl. No.: 687,075

[22] Filed: Jul. 15, 1996

[51] Int. Cl.[6] ..... F01D 25/28

[52] U.S. Cl. ..... 277/199; 277/192; 277/155; 277/218; 277/219; 24/17 B; 24/205; 24/459; 403/292; 403/293

[58] Field of Search ..... 277/155, 192, 277/199, 218, 219; 403/292, 293; 24/17 B, 205, 459

[56] References Cited

U.S. PATENT DOCUMENTS

| | | | |
|---|---|---|---|
| 2,498,968 | 2/1950 | Viewegh | 416/247 |
| 5,073,088 | 12/1991 | Peng | 416/247 R |

FOREIGN PATENT DOCUMENTS

| | | | |
|---|---|---|---|
| 417241 | 6/1947 | Italy | 416/247 |
| 0763620 | 9/1980 | U.S.S.R. | 24/459 |

*Primary Examiner*—William A. Cuchlinski, Jr.
*Assistant Examiner*—Christina Annick
*Attorney, Agent, or Firm*—Alfred Lei

[57] ABSTRACT

A wire cover packing ring for securing the wire cover of an electric fan in place, including a plurality of elastic connectors, and a plurality of smoothly arched ring sections connected into a ring by the elastic connectors, each of the smoothly arched ring sections having a plurality of longitudinally spaced tabs at the inside adapted for securing to the wire cover of the electric fan, and two substantially L-shaped hooks at two opposite ends adapted for connecting to the corresponding elastic connectors, each of the elastic connectors having two hook holes at two opposite ends adapted for coupling to the hooks of the smoothly arched ring sections respectively.

1 Claim, 3 Drawing Sheets

WIRE COVER PACKING RING OF AN ELECTRIC FAN

BACKGROUND OF THE INVENTION

1. Field of the Invention

This invention relates to a wire cover packing ring adapted for securing the wire cover of an electric fan in place, and relates more particularly to such a wire cover packing ring which automatically compensates the manufacturing tolerance of the wire cover.

2. Description of the Prior Art

Regular wire cover packing rings for electric fans are commonly made in the Shape of a split ring. This structure of wire cover packing ring fits wire covers of one particular size only. Further, because the manufacturing tolerance of the wire cover is inevitable and which manufacturing tolerance may be as high as up to about 1–1.2 mm, the installation of the wire cover packing ring may be difficult to be achieved.

Therefore, it is an object of the present invention to provide a wire cover packing ring of an electric fan which can obviate and mitigate the above-mentioned drawbacks.

SUMMARY OF THE INVENTION

This invention relates to a wire cover packing ring adapted for securing the wire cover of an electric fan in place, and relates more particularly to such a wire cover packing ring which automatically compensates the manufacturing tolerance of the wire cover.

According to the present invention, the wire cover packing ring is comprised of a plurality of elastic connectors, and a plurality of smoothly arched ring sections connected into a ring by the elastic connectors, wherein each of the smoothly arched ring sections comprises a plurality of longitudinally spaced tabs at the inside adapted for securing to the wire cover of the electric fan, and two substantially L-shaped hooks at two opposite ends adapted for connecting to the corresponding elastic connectors; each of the elastic connectors comprises two hook holes at two opposite ends adapted for coupling to the hooks of the smoothly arched ring sections respectively. Because the elastic connectors are elastic, the diameter of the wire cover packing ring can be flexibly adjusted to fit the size of the fire cover in use.

DETAILED DESCRIPTION OF THE PREFERRED EMBODIMENT

Figure 1B:
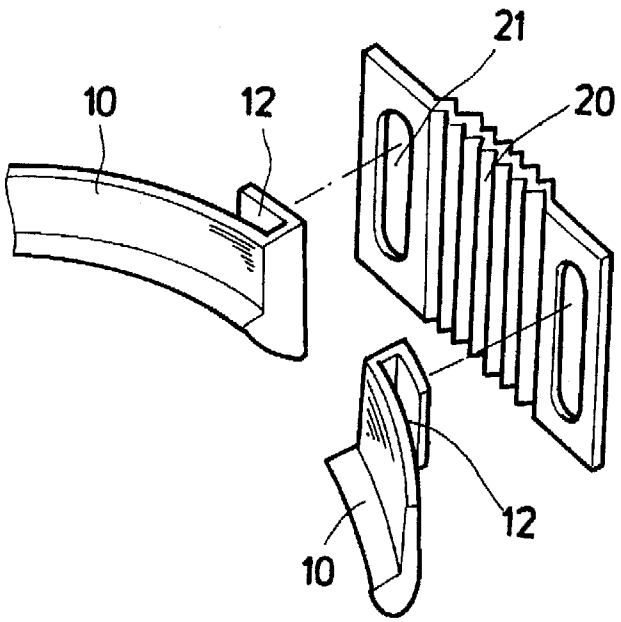
FIG. 1B is an enlarged view of FIG. 1.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 3:
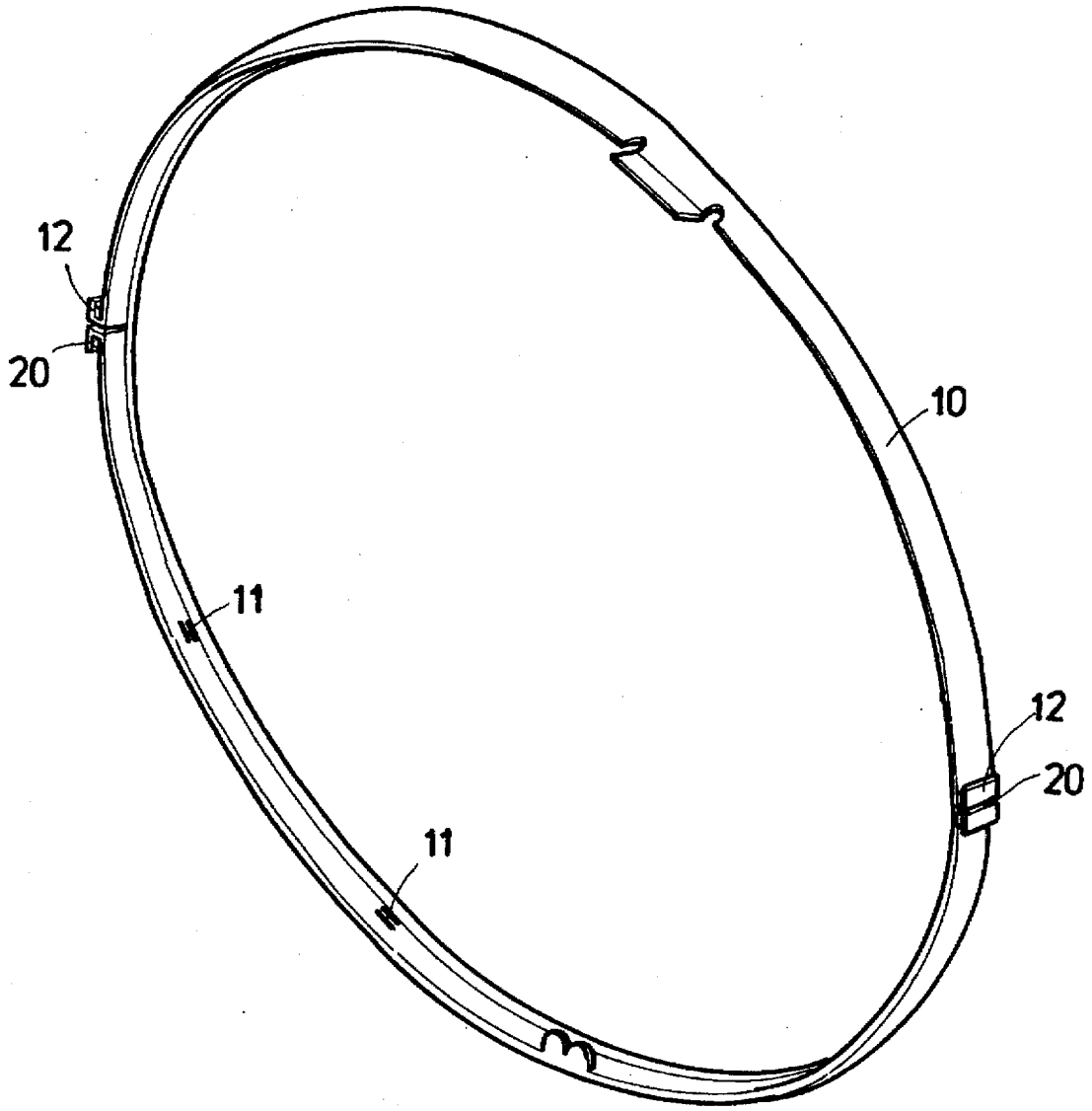
FIG. 3 is an elevational assembly view of the packing ring shown in FIG. 1.

Referring to FIG. 3, a packing ring in accordance with the present invention is comprised of a plurality of elastic connectors 20, and a plurality of smoothly arched ring sections 10 connected into a ring by the elastic connectors 20.

Figure 1A:
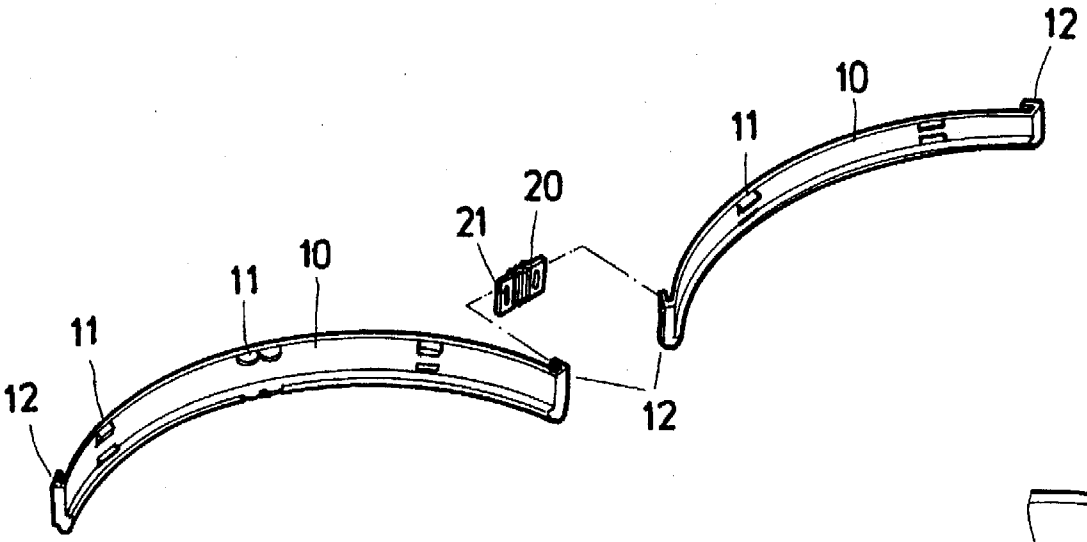
FIG. 1A is an exploded view of a part of the packing ring according to the preferred embodiment of the present invention.

Referring to FIGS. 1A and 1B, each of the smoothly arched ring sections 10 comprises a plurality of longitudinally spaced tabs 11 perpendicularly raised from the inner side and adapted for securing to the wire cover of the fan, and two substantially L-shaped hooks 12 at two opposite ends adapted for connecting to the corresponding elastic connectors 20. The elastic connectors 20 are made from elastic material, each comprising two hook holes 21 at two opposite ends adapted for coupling to the hooks 12 of the smoothly arched ring sections 10 respectively.

Figure 2:
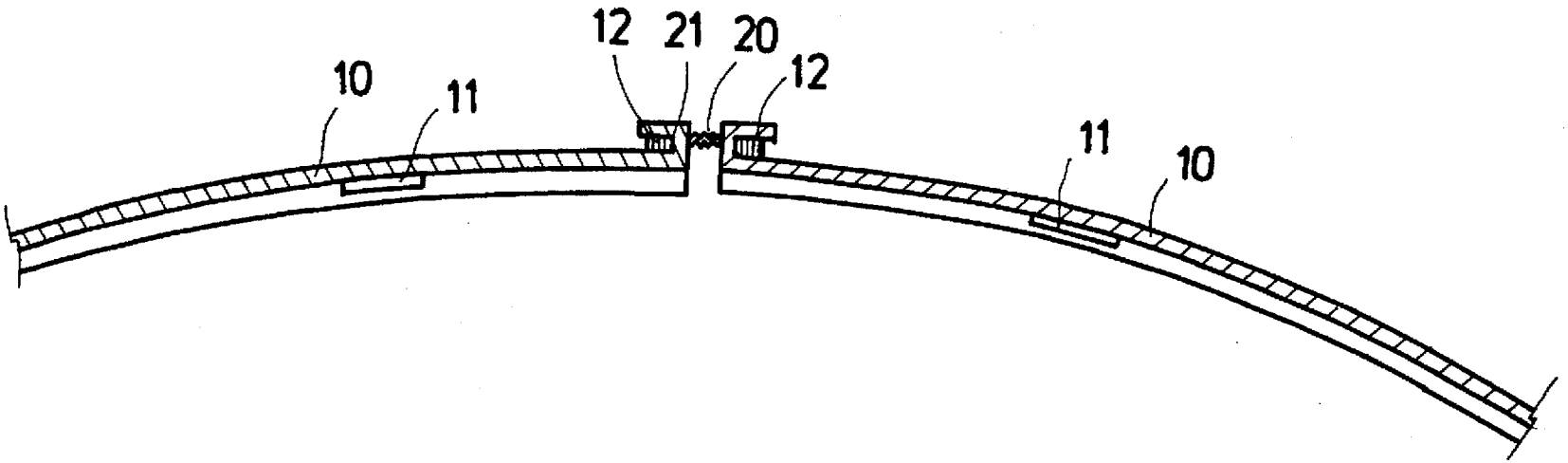
FIG. 2 is a sectional view of the present invention.

Referring to FIGS. 2 and 3, by coupling the hook holes 21 of the elastic connectors 20 to the L-shaped hooks 12 of the smoothly arched ring sections 10, the smoothly arched ring sections 10 are connected into a ring. Because the elastic connectors 20 are respectively connected between each two adjacent smoothly arched ring sections 10, the diameter of the packing ring can be flexibly adjusted within a limited range to fit the wire cover of the fan.

The invention is naturally not limited in any sense to the particular features specified in the forgoing or to the details of the particular embodiment which has been chosen in order to illustrate the invention.

Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A wire cover packing ring comprising a plurality of elastic connectors, and a plurality of smoothly arched ring sections connected into a ring by said elastic connectors, each of said smoothly arched ring sections comprising a plurality of longitudinally spaced tabs perpendicularly raised from an inner side of each of said smoothly arched ring sections, and two substantially L-shaped hooks at two opposite ends adapted for connecting to the corresponding elastic connectors, each of said elastic connectors having two hook holes at two opposite ends adapted for coupling to the hooks of said smoothly arched ring sections respectively.

* * * * *